US006427949B1

(12) United States Patent
Hager et al.

(10) Patent No.: US 6,427,949 B1
(45) Date of Patent: Aug. 6, 2002

(54) CONTACTLESS POINT DETECTION SYSTEM FOR RAILROAD SWITCH

(75) Inventors: Mark Alan Hager, Rochester; Michael F. Towey, Jr., Pittsford, both of NY (US)

(73) Assignee: Alstom Signaling, Inc., Rochester, NY (US)

( * ) Notice: Subject to any disclaimer, the term of this patent is extended or adjusted under 35 U.S.C. 154(b) by 0 days.

(21) Appl. No.: 09/767,575

(22) Filed: Jan. 23, 2001

(51) Int. Cl.[7] ..... E01B 7/00

(52) U.S. Cl. ..... 246/220; 246/476; 246/253; 246/260

(58) Field of Search ..... 246/220, 218, 246/225, 240, 260, 162, 151, 476, 449, 253

(56) References Cited

U.S. PATENT DOCUMENTS

| | | | | |
|---|---|---|---|---|
| 1,781,284 A | * | 11/1930 | Karl | 246/220 |
| 4,514,689 A | | 4/1985 | Gerard | |
| 4,841,767 A | | 6/1989 | Morel | |
| 4,892,328 A | | 1/1990 | Kurtzman et al. | |
| 4,986,498 A | * | 1/1991 | Rotter et al. | 246/458 |
| 5,036,275 A | * | 7/1991 | Munch et al. | 324/207.17 |
| 5,109,675 A | | 5/1992 | Hwang | |
| 5,192,038 A | * | 3/1993 | Ocampo | 246/220 |
| 5,206,616 A | * | 4/1993 | Stegmuller | 218/136 |
| 5,257,014 A | | 10/1993 | Zimmermann | |
| 5,617,023 A | * | 4/1997 | Skalski | 324/207.17 |
| 5,668,587 A | | 9/1997 | Alstine et al. | |
| 5,806,809 A | * | 9/1998 | Danner | 246/220 |

* cited by examiner

*Primary Examiner*—S. Joseph Morano
*Assistant Examiner*—Frantz F. Jules
(74) *Attorney, Agent, or Firm*—Ohlandt, Greeley, Ruggiero & Perle, LLP

(57) ABSTRACT

A contactless detection system for detecting the movements of the switch points of a railroad switch and stock rail of a railroad switch/point having a transformer for detecting or sensing the position of the switch points, the transformer having a core linked to the switch points, and further having a primary coil and a pair of secondary coils wound around the core; and an electronic interface means for receiving signals from the secondary coils responsive to, and corresponding with, the positioning of the switch points.

8 Claims, 1 Drawing Sheet

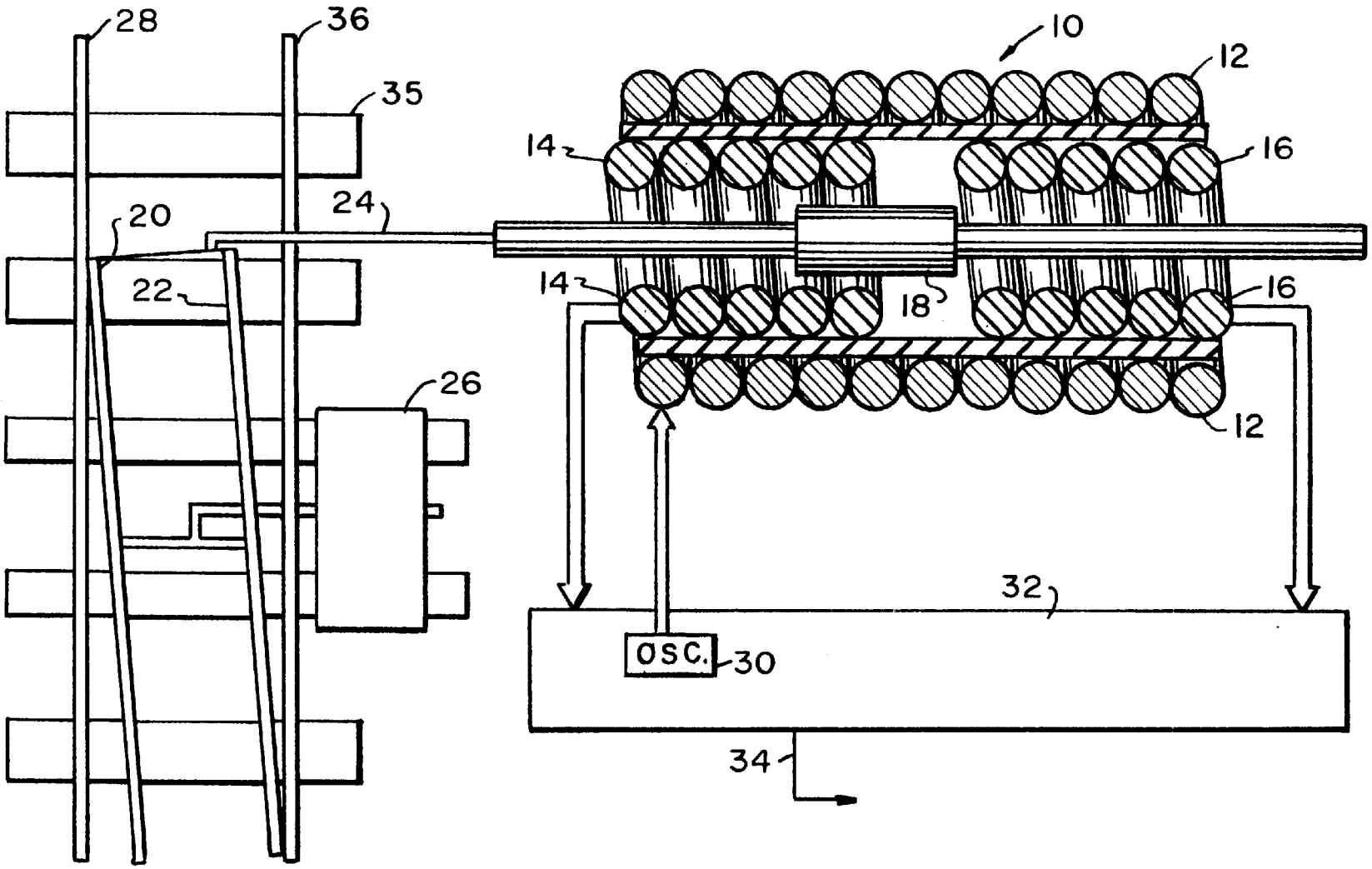
10
12
16
16
12
18
14
14
32
OSC.
30
34
26
35
36
24
22
20
28

CONTACTLESS POINT DETECTION SYSTEM FOR RAILROAD SWITCH

FIELD OF THE INVENTION

This invention relates to railroad switches and particularly to mechanisms for detecting the movements of the switches, or switch points, that function to alter train directions.

BACKGROUND OF THE INVENTION

It is well known in the railroad arts to provide an electric motor-driven switch machine for positioning a railroad track at a switching point, and coupling therewith a railpoint detection and indication mechanism. In particular, the detection and indication mechanism includes a sensor that identifies a condition when the railroad tracks are not at, or near, their proper positions before or after switching of the railroad tracks.

The traditional approach with a railpoint detection and indication mechanism is to provide a mechanical rod that moves with the switch points. The rod interacts with levers and cams inside of the switch machine or switch circuit controller and the lever is actually a series of dry contacts. These contacts are used for indication by means of vital relays or vital interlocking processor type systems.

A variety of mechanical systems have been proposed or produced over the years but since they usually call for mechanical rods and the like, they require substantial adjustment every so often. They may also involve finger contacts, toggling arms, rotary cam switches, and the like. The large amount of adjustment, sometimes required monthly, is a substantial drawback to such mechanical systems or arrangements for detecting switchpoint movement, and the cost is high because the maintenance is so labor intensive.

Accordingly, it is a primary object of the present invention to eliminate the labor intensive adjustments required with mechanical arrangements and to provide a contactless point detector system that will completely eliminate the need for constant adjustment of parts.

Another object of the present invention is to provide a fast and easy way to adjust switch point detector system involving push button electronic calibration such that the maintainer will simply insert his obstruction gauge in the points and then press a calibration button. Moreover, because of the lack of contacts, mechanical wear is absolutely minimized and the system is inexpensive, when compared to the traditional, dry contact switch and lever approach.

SUMMARY OF THE INVENTION

It will be understood that in the operation of the detection system of the present invention, the movement of the switchpoints is produced by a conventional or standard form of switch machine in which an electric motor, or hand throw mechanism, provides the power for the selected movement.

Briefly stated then, the system of the invention is a contactless detection system for detecting the movement of the switchpoints of a railroad switch, such system including a transformer means for detecting or sensing the position of the switchpoints. The transformer means has a ferrous core that is linked to the switch points, and both a primary coil and a pair of secondary coils are wound around the core. The preferred form of this transformer means is referred to as a linear variable differential transformer (LVDT). An electronic interface means is further included for receiving signals from the secondary coils of the transformer responsive to, and corresponding with, the positioning of the switch points.

The system of the invention will also detect the position of the stock rail. Occasionally, the stock rail moves with respect to the railroad ties due to the track hardware loosening up. As the stock rail moves, the switch points move. The LVDT senses this movement and indicates that the stock rail has shifted.

An additional major feature of the present invention resides in the provision of operational vitality by which is meant that the detector or sensor is arranged to be vital such that any failure must cause the system to be as safe as the system was before the failure. The linear variable differential transformer forming an essential part of the system can fail in many different modes including 1) shorts in one or more coils to ground; 2) shorts from the primary coil to one or more secondary coils; 3) shorts from secondary to secondary; 4) one or more of the coils failing open; 5) change in resistance in one or more of the coils (up or down); 6) damaged core.

The foregoing and still further objects and advantages of the present invention will be more apparent from the following detailed explanation of the preferred embodiments of the invention in connection with the accompanying drawings:

BRIEF DESCRIPTION OF THE DRAWING

The FIGURE is a block schematic diagram of a preferred embodiment of the detection system for detecting the positioning of the switch points for a railroad switch system.

DETAILED DESCRIPTION OF THE INVENTION

Referring now to the FIGURE, the linear variable differential transformer (LVDT) in its entirety is designated 10. In this embodiment, the LVDT is a transformer device with a single primary coil 12 and two secondary coils 14 and 16. A ferrous core 18 is disposed axially of the transformer coils and moves linearly with respect thereto. The moving core changes the inductance of the device and the change in inductance causes the signal coupled from the primary of the LVDT to the two secondaries to change. This change in voltage is directly proportional to the position of the core. The ferrous core is linked to the switchpoints 20 and 22 by linkage 24. In a conventional manner, a switch machine 26 pushes and pulls switch points 20 and 22. Also seen in the FIGURE are stock rails 28 and 36, as well as ties 35.

It will be appreciated that the LVDT 10 receives a modulated input from oscillator 30 forming a part of the interface means 32 and designated here as the vital electronics and signal processor. A signal output line 34 is provided to transmit output signals to suitable relays or to a control system. The two secondaries 14 and 16 are wound in opposite directions and this means that the signal from secondary 1 is exactly 180° out of phase with respect to secondary 2.

It will be understood that the core's position is measured by taking the peak value of secondary coil #1 and subtracting it from the peak value of secondary core #2, which is accomplished with interface means 32.

In accordance with one form of the vitality feature of the present invention, the LVDT is made vital by taking advantage of the 180° phase shift which exists between the two secondaries. This means that as the core moves, the voltage amplitude of the two secondaries changes. The voltage amplitude of one secondary will increase while the amplitude of the other will decrease. When the core is in the center of the LVDT, the voltage amplitudes of the two secondaries will be equal. Because the two secondary signals are phase-shifted 180° and the relative amplitudes are related to the core position, the absolute value of secondary coil #1 plus the absolute value of secondary coil #2 is a constant value. This constant value provides the vital check signal.

The electronics provided in the interface means 32 that is connected to the LVDT 10 will monitor this vital check signal. As long the vital check signal is constant, the LVDT is working properly. If the LVDT fails in any of the failure modes noted, the vital check signal will change. The electronics that interface with the LVDT will sense that change and will disable the output in the system.

The LVDT sensor 10 is also vital by reason of the mechanism that is used to decode the signal and the relationship of the core. As the core 18 moves linearly through the transformer, the voltage from the secondaries (derived from the position) also changes linearly. The electronic interface 32 reads the change in voltage from the LVDT's output and compares it to the previous voltage value. The new voltage value must be within allowable limits with respect to the previous voltage value. If the new voltage is not within the allowable limits, then the system must be malfunctioning. The system will shut down. For example, if the original output is 1.20 volts and the system is operating in 0.10 volt increments, the next value must be 1.30 volts or 1.10 volts (+/−a range). If any other value is measured, the system is faulty and must be shut down.

Another aspect of the vital nature of the system is to verify that the measured signal is legitimate. For example, it is necessary that the system will fail safely if the electronics that read the signal from the LVDT were to fail by locking up at a specific value. This is accomplished by modulating the input signal that drives the primary of the LVDT. The input signal to the primary will be turned on and off at a specific frequency. The monitoring electronics will read the on and off cycling to verify that the input to the electronics has not failed. If the electronics do not recognize the on and off state at the proper frequency, the inputs and or the sensor has failed. The system will then be shut down.

It should be noted that the system will detect the position of the stock rail 28 with respect to the railroad ties 35. As a matter of course, the switch point 20 applies outward pressure to the stock rail 28. As the hardware that connects the stock rail 28 to the ties 35 loosens up over time, the stock rail moves outward with respect to the switch point 20 due to the switch point pressure. The LVDT will detect this outward stock rail movement by the means of an outward core movement and thus, generate the corresponding signal. The system will also detect the position of stock rail 36 with respect to railroad ties 35 and switch point 22 with similar means.

The invention having been thus described with particular reference to the preferred forms thereof, it will be obvious that various changes and modifications may be made therein without departing from the spirit and scope of the invention as defined in the appended claims.

What is claimed is:

1. A contactless detection system adapted for detection the movement of the switch points of a railroad switch comprising:

a transformer for detecting or sensing the position of the switch points, the transformer having a core adapted to link with the switch points, and further having a primary coil means and a secondary coil means wound around the core; and an electronic interface means for receiving signals from the secondary coil means responsive to, and corresponding with, the positioning of the switch points;

wherein the secondary coil means has two secondary coils wound in opposite directions.

2. A contactless detection system as defined in claim 1, further comprising a source for providing a signal to the primary coil means.

3. A contactless detection system as defined in claim 2, further including a switch machine operative for moving the switch points.

4. A contactless detection system as defined in claim 3, further comprising a control device connected to the interface means.

5. A contactless detection system as defined in claim 1, in which there is a 180° phase shift between the output voltages of the two secondary coils such that as the core moves, the voltage amplitude of one secondary coil increases while the voltage amplitude of the other secondary coil decreases, wherein if the core is in the center of the transformer means, the voltage amplitudes of the two secondary coils will be equal.

6. A contactless detection system as defined in claim 5, wherein the absolute value of one secondary coil voltage plus the absolute value of the other secondary coil voltage is a constant whereby this constant value is a vital check signal, and means for sensing that the vital check signal is constant.

7. A contactless detection system as defined in claim 1, further including means for providing fail-safe operation of the system, said means including means for comparing a current voltage value with a previous voltage value from the output of the transformer, wherein the current voltage value must be within allowable limits, otherwise, the system is shut down.

8. A contactless detection system as defined in claim 1, comprising means for providing fail-safe operation of the system, said means including means for modulating an input signal to the primary coil means of the transformer at a specific frequency, and means for recognizing the absence of the frequency as the presence of a failure, and in response thereto, for shutting down the system.

* * * * *